US012377341B2

(12) United States Patent
Wang

(10) Patent No.: US 12,377,341 B2
(45) Date of Patent: Aug. 5, 2025

(54) DISPLAY DEVICE FOR SHOWING COURT LINE ON INDOOR FIELD

(71) Applicant: Advanced Connection Technology, Inc., New Taipei (TW)

(72) Inventor: Ching-Shun Wang, New Taipei (TW)

(73) Assignee: ADVANCED CONNECTION TECHNOLOGY, INC., New Taipei (TW)

( * ) Notice: Subject to any disclaimer, the term of this patent is extended or adjusted under 35 U.S.C. 154(b) by 763 days.

(21) Appl. No.: 17/737,108

(22) Filed: May 5, 2022

(65) Prior Publication Data

US 2023/0356062 A1 Nov. 9, 2023

(51) Int. Cl.
*A63C 19/06* (2006.01)

(52) U.S. Cl.
CPC ..... *A63C 19/065* (2013.01)

(58) Field of Classification Search
CPC ..... A63C 19/065
See application file for complete search history.

(56) References Cited

U.S. PATENT DOCUMENTS

| | | | | |
|---|---|---|---|---|
| RE32,842 E * | 1/1989 | Wigoda | A63C 19/065 473/467 |
| 5,672,128 A * | 9/1997 | Conn | A63B 71/0605 473/467 |
| 2006/0287140 A1* | 12/2006 | Brandt | A63B 71/0605 473/467 |
| 2012/0010030 A1* | 1/2012 | Bousseksou | A63C 19/065 473/490 |
| 2017/0007912 A1* | 1/2017 | Yan | A63C 19/065 |
| 2018/0117403 A1* | 5/2018 | Meetin | A63B 71/02 |
| 2018/0203558 A1* | 7/2018 | Shim | G06F 3/0393 |

* cited by examiner

*Primary Examiner* — Eugene L Kim
*Assistant Examiner* — Christopher Glenn
(74) *Attorney, Agent, or Firm* — McClure, Qualey & Rodack, LLP

(57) ABSTRACT

A display device for showing a court line is provided. The court line is adapted to be shown on an indoor field. The display device includes field line sets disposed on a predetermined field. The field line sets have marker lines, and two or more of the marker lines overlap with each other. Each marker line includes a thin transparent body. The thin transparent body includes a protective film, a conductive layer, a light-emitting layer, an insulating layer, and an electrode layer. The light-emitting layer is made of a material including an electrochromic material. Each marker line in each field line set has an independent circuit loop. Thus, by energizing the light-emitting layer of the desired marker lines to make it emit light, the desired court lines will be shown correspondingly, thus avoiding the problem of causing users to be confused among multiple sets of court lines.

10 Claims, 6 Drawing Sheets

DISPLAY DEVICE FOR SHOWING COURT LINE ON INDOOR FIELD

FIELD

Background

Technical Field

The present disclosure relates to a display device, in particular, to a display device for showing a court line adapted to be shown on an indoor field.

RELATED ART

Badminton, volleyball, squash, tennis, basketball, and other ball sports are deeply loved by people. However, due to the limited space of the field (e.g., an indoor court), it is common to combine different types of ball sports in the same field. Generally, tapes having different colors are attached to the field for marking different courts on the same field. In such situation, for example, the court marker lines of volleyball, the court marker lines of basketball, etc. are shown on the same field at the same time. Therefore, players on such field may be confused and/or misread the markings during the contest, which greatly affects the performance of the players. Moreover, the referee might make wrong judgement due to misreading the markings as well.

SUMMARY

In order to solve the aforementioned problem(s), in some embodiments, a display device for showing a court line is provided, and the court line is adapted to be shown on an indoor field. The display device includes a plurality of field line sets disposed on a predetermined field, wherein the field line sets together have a plurality of marker lines, and at least two of the marker lines overlap with each other to form an overlapped region. Each of the marker lines includes a thin transparent body, wherein the transparent body includes a protective film, a conductive layer, a light-emitting layer, an insulating layer, and an electrode layer; the protective film, the conductive layer, the light-emitting layer, the insulating layer, and the electrode layer are arranged in sequence from top to bottom. The light-emitting layer is made of a material comprising an electrochromic material. Each of the marker lines in each of the field line sets has an independent circuit loop formed by a conductive line.

In some embodiments, each of the marker lines is formed by at least one selected from the group consisting of a dot, a line, and a plane, and each of the marker lines is at least one selected from the group consisting of a straight segment, an arc segment, and a circle segment.

In some embodiments, each of the marker lines further includes a floor color layer as the bottommost layer of the marker line, and the floor color layer has a color substantially the same as a color of the predetermined field.

In some embodiments, the marker lines have a first marker line and a second marker line, and the first marker line and the second marker line belong to the same field line set or respectively belong to different field line sets. The first marker line has a hollow portion located correspondingly at the overlapped region.

In some embodiments, the first marker line has a connecting segment, and the connecting segment is on a side of the hollow portion and contacts the second marker line.

In some embodiments, in the overlapped region, an extension direction of the first marker line and an extension direction of the second marker line are not parallel to each other.

In some embodiments, in the overlapped region, an extension direction of the first marker line and an extension direction of the second marker line are parallel to each other.

In some embodiments, the display device further includes a power source, wherein the conductive line of each of the marker lines in each of the field line sets is connected to the power source and the transparent body.

In some embodiments, the power source includes a transformer connected to supply mains, wherein the transparent body is connected to supply mains through the conductive line, and the supply mains is transformed by the transformer before being used.

In some embodiments, each of the marker lines has a contact detector located in the transparent body.

Accordingly, in some embodiments, the light-emitting layer of the display device is made of a material including an electrochromic material. Therefore, by energizing the light-emitting layer of the desired marker lines to display desired court lines only, the problem of causing users to be confused among multiple sets of court lines can be avoided. In some embodiments, the display device is adapted to display more than two kinds of court lines in the same indoor field at different times, and thus the land cost can be further reduced. In some embodiments, the transparent body of the display device can be directly disposed on the existing indoor field, so that the existing indoor field does not need additional operations such as digging holes and burying lines, thereby simplifying the installation of the display device.

BRIEF DESCRIPTION OF THE DRAWINGS

The disclosure will become more fully understood from the detailed description given herein below for illustration only, and thus not limitative of the disclosure, wherein.

DETAILED DESCRIPTION

Figure 1:
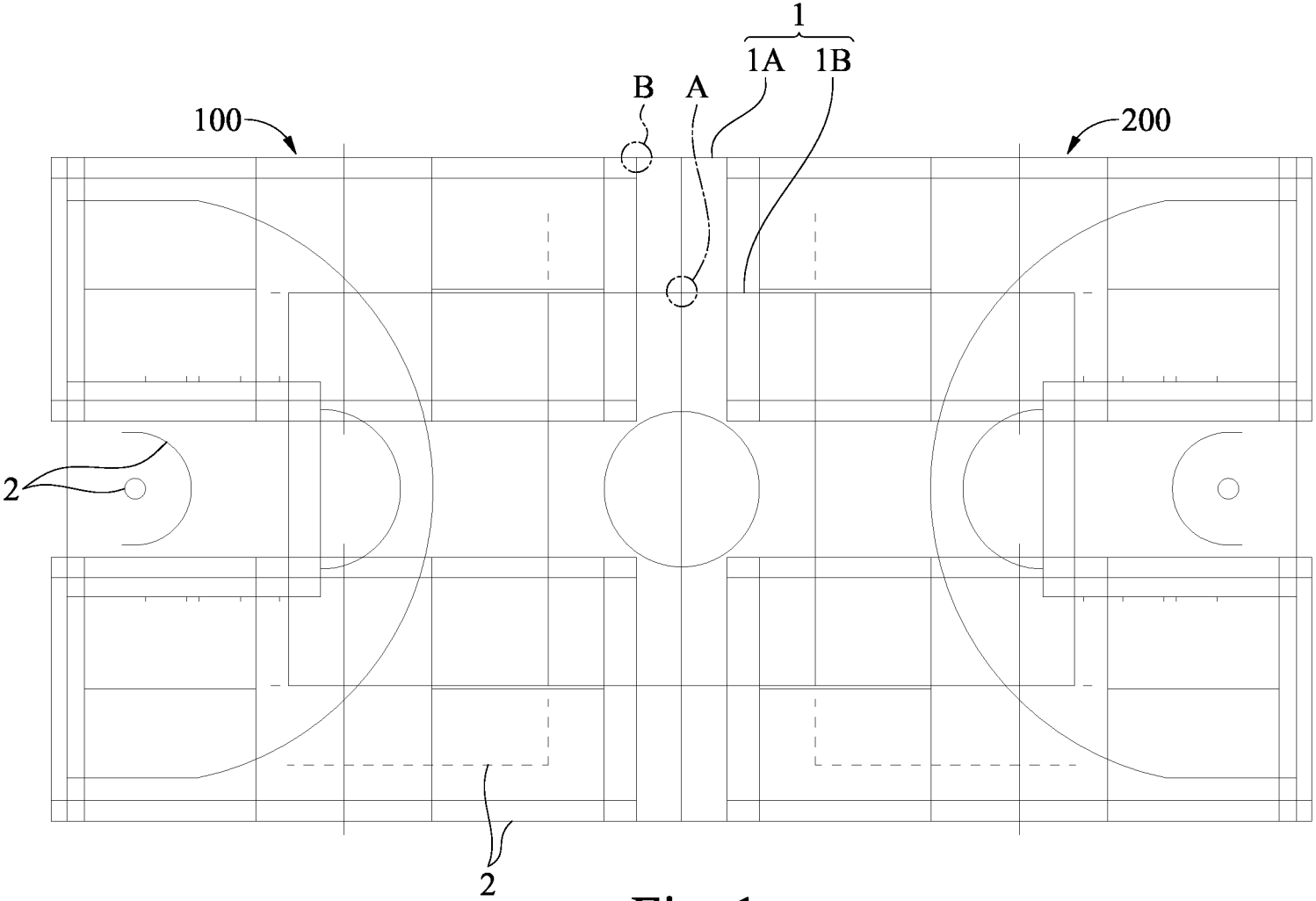
FIG. 1 illustrates a schematic top view of court lines on an indoor field according to some embodiments of the present disclosure.

Please refer to FIG. 1. FIG. 1 illustrates a schematic top view of court lines on an indoor field. In some embodiments, a display device 100 is applied on a field for two or more kinds of sports, such as basketball, badminton, tennis, volleyball, squash, etc. Besides being applied on a sport field, in some embodiments, the display device 100 can also be applied in various venues such as an exhibition venue, a wedding banquet venue, a food court, etc. In some embodiments, the display device 100 is installed on an indoor field for conveniently accessing to supply mains, but not limited thereto.

Please still refer to FIG. 1. In some embodiments, the display device 100 includes a plurality of field line sets 1, and each of the field line sets 1 is disposed in the same field 200. The same field 200 may be referred to an indoor area assigned as an individual sport field. Thus, for example, a large sport venue may have many different sport fields (such as a plurality of basketball courts) at different regions, and each of the sport fields belongs to a different field. In some embodiments, the same field 200 is, for example, a multi-purpose sport field for basketball, volleyball and badminton. In other words, in this field 200, court field lines such as the volleyball court lines 1B of the volleyball court and the badminton court lines of the badminton court are disposed in the area of a basketball court.

Figure 2:
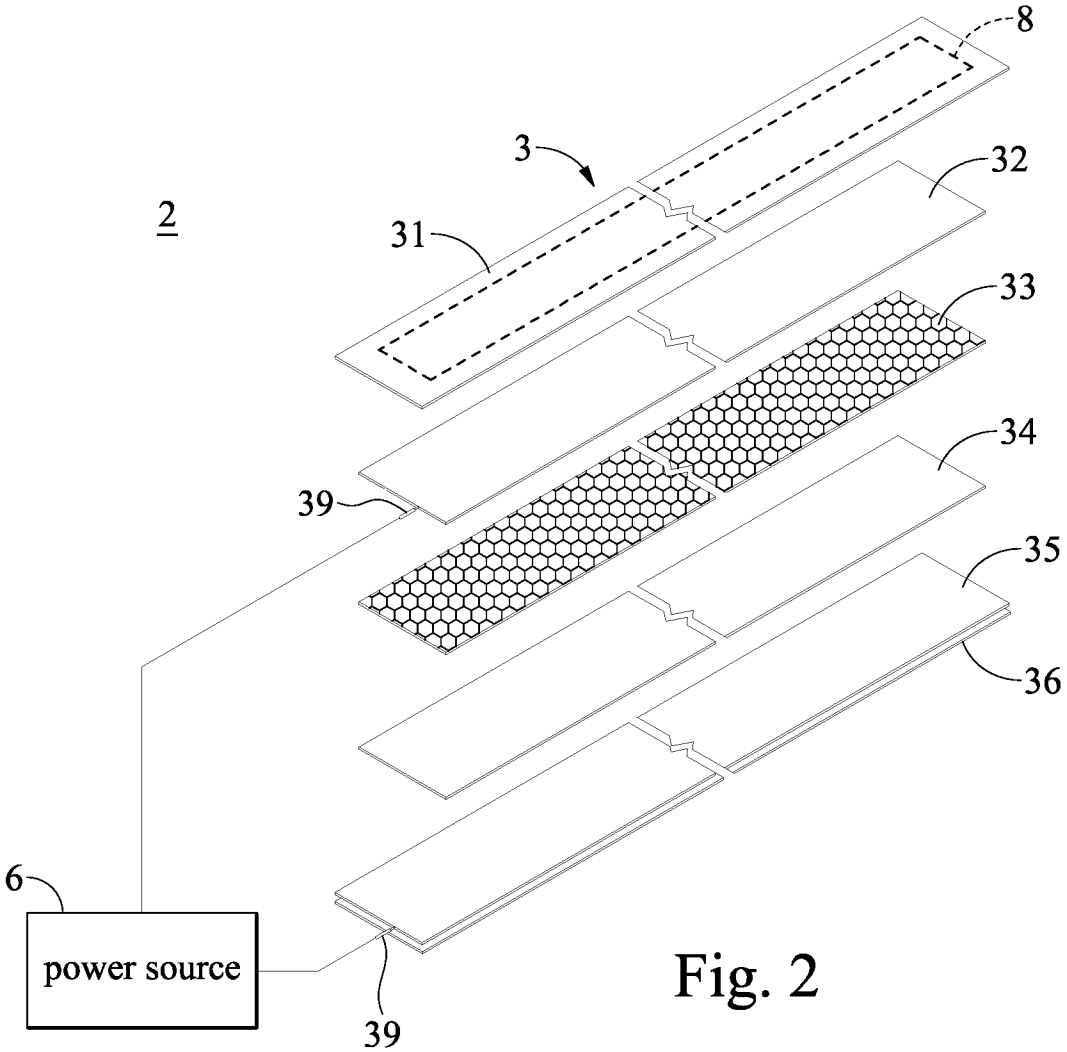
FIG. 2 illustrates a schematic exploded view of a marker line of a display device according to some embodiments of the present disclosure.

The field line sets 1 together have a plurality of marker lines 2, and at least two of the marker lines 2 overlap with each other. Each of the marker lines 2 includes a thin transparent body 3. Each of the transparent bodies 3 includes a protective film 31, a conductive layer 32, a light-emitting layer 33, an insulating layer 34, and an electrode layer 35. The protective film 31, the conductive layer 32, the light-emitting layer 33, the insulating layer 34, and the electrode layer 35 are arranged in sequence from top to bottom (as shown in FIG. 2). The light-emitting layer 33 is made of a material including an electrochromic material. Each of the marker lines 2 in each of the field line sets 1 has an independent circuit loop formed by conductive line 39.

Please refer to FIG. 1. In some embodiments, each of the field line sets 1 may have a single marker line 2 or several marker lines 2 for forming the field line set 1. For example, it can be the case that a single marker line 2 or several marker lines 2 together form a field line set 1 for a basketball court line 1A, a volleyball court line 1B, or a badminton court line. Taking the field line set 1 having several marker lines 2 as an example, each of the marker lines 2 has an independent circuit loop formed by its conductive line 39 (as shown in FIG. 2), and the marker lines 2 in different field line sets 1 belong to different circuit loop as well. Therefore, each of the field line sets 1 can be controlled independently.

Figure 5:
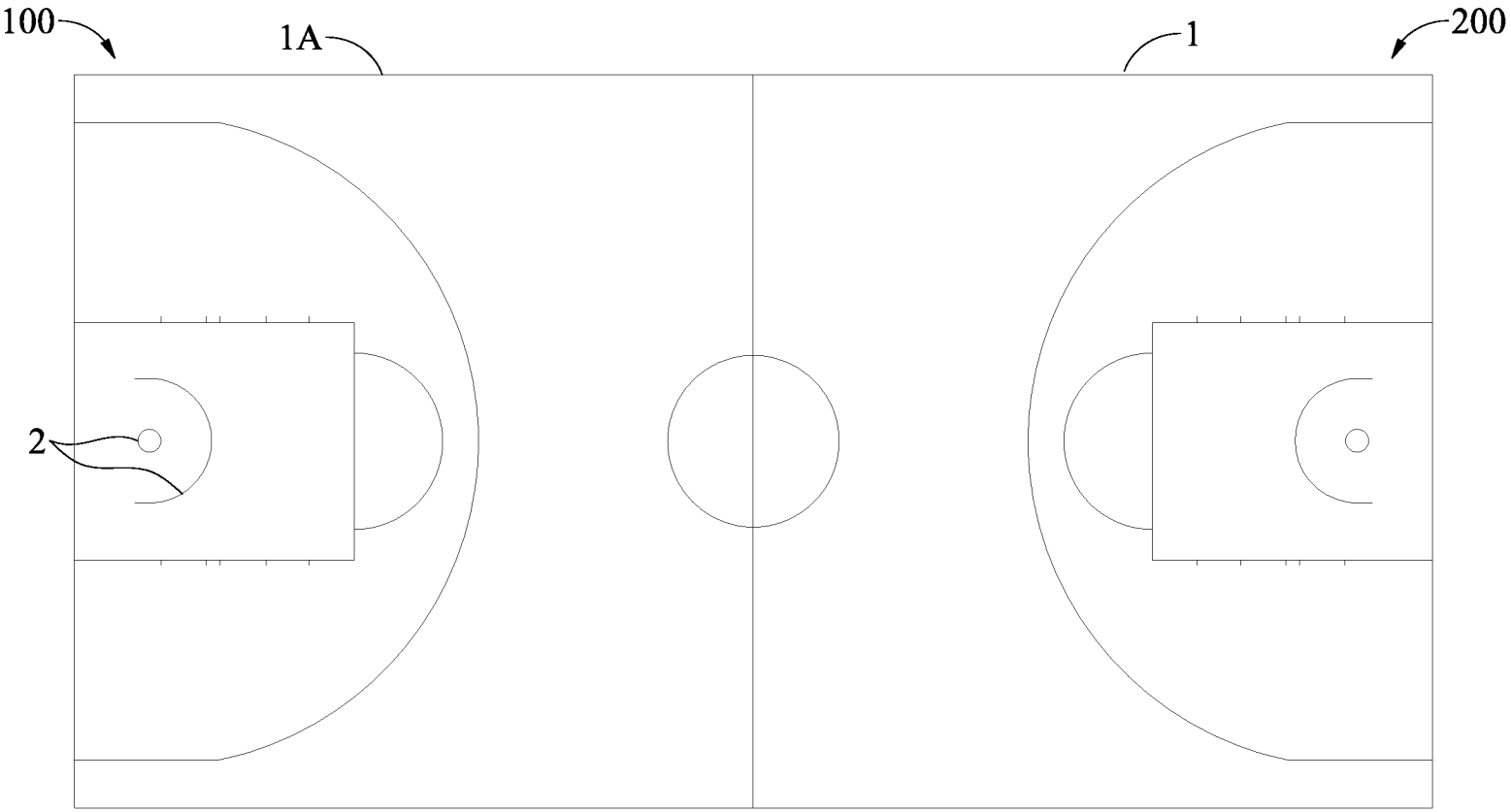
FIG. 5 illustrates a schematic top view of a first court line according to some embodiments of the present disclosure.

Please refer to FIG. 1, since each of the field line sets 1 can be controlled independently, in some embodiments, each of the field line sets 1 can be used for different kinds of sport court line. For example, when the basketball court line 1A of the basketball court is to be used, the marker line(s) 2 of such field line set 1 is energized to show the basketball court line 1A (as shown in FIG. 5), while other field line sets 1 (such as those for the volleyball court line 1B and the badminton court line) are not energized and thus not be shown. Similarly, when the volleyball court line 1B of the volleyball court is to be used, the marker line(s) 2 of such field line set 1 is energized to show the volleyball court line 1B (as the thicker line shown in FIG. 6), while other field line sets 1 (such as those for the basketball court line 1B and the badminton court line) are not energized and thus not be shown. Thereby, the problem of confusion caused by marking different sport court lines on the same field with different colored tapes can be solved.

Figure 6:
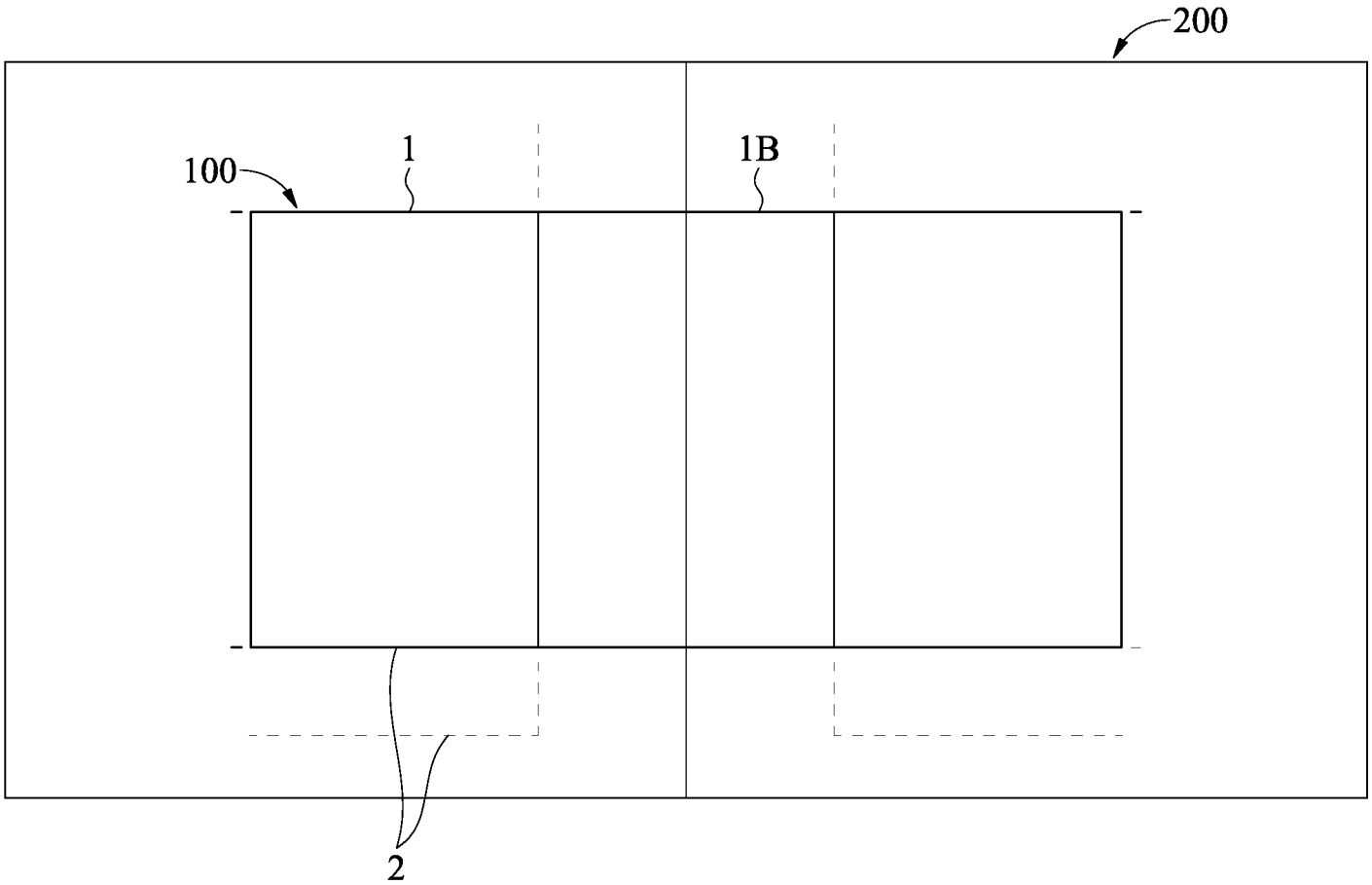
FIG. 6 illustrates a schematic top view of a second court line according to some embodiments of the present disclosure.

In some other embodiment, since each of the marker lines 2 has an independent circuit loop and thus can be controlled independently, a part of the field line sets 1 for different sports can also be used together depending on the user needs. For example, as shown in FIG. 6, not only the marker line(s) 2 of the volleyball court is turned on to display the volleyball court line 1B, but also a part of the field line set 1 of the basketball court line 1A is turned on to indicate the outer boarder line of the field (as the thinner line shown in FIG. 6).

Please refer to FIG. 2. FIG. 2 illustrates a schematic exploded view of the marker line 2. In some embodiments, the electrochromic material of the light-emitting layer 33 may be zinc sulfide (ZnS) doped with copper or silver, blue diamond (boron contained), gallium arsenide, etc. The light-emitting layer 33 has a property of emitting light in response to the passage of an electric current or to a strong electric field, where the phenomenon is also known as electroluminescence (EL for short, or electric field luminescence, or cold light). The brightness of the light emitted by the light-emitting layer 33 can vary, depending on the voltage level and the frequency of the AC voltage applied to the light-emitting layer 33 or the voltage level of the DC voltage applied to the light-emitting layer 33.

Referring to FIG. 2, in some embodiments, when a voltage is applied to the two electrodes respectively at the conductive layer 32 and the electrode layer 35, the electric field causes excited transitions of electrons in zinc sulfide (ZnS), thereby allowing the light-emitting layer 33 to glow. The brightness of the light due to electroluminescence varies with the voltage (and frequency, if the power source 6 is an alternating current (AC)) between the electrodes. As the voltage and frequency increase, the brightness increases accordingly.

Referring to FIG. 2, in some embodiments, when a voltage is applied to the conductive layer 32 and the electrode layer 35, an electric field is generated between the electrodes of the conductive layer 32 and the electrode layer 35. The electrons collide with the electrochromic material included in the light-emitting layer 33 under the effect of the electric field, so that the electrons of the electrochromic material originally existing in the ground state obtain enough energy to transition to the excited state, and then these excited electrons transition back to the ground state to release energy in the form of light. Under the effect of the electric field, the electrons can be driven from the electrode to enter the insulating layer 34 through the tunneling effect, so that the electrons are gathered at the interface between the insulating layer 34 and the light-emitting layer 33. When the voltage across the transparent body 3 is gradually increased to generate a critical electric field, the electrons gathered at the interface between the insulating layer 34 and the light-emitting layer 33 will tunnel into the light-emitting layer 33. The electrons are accelerated by the high electric field and become hot electrons in the light-emitting layer 33. The outer electrons of the light-emitting center in the light-emitting layer 33 are impacted by these accelerated electrons, resulting in the electron transition that the outer electrons are elevated to the energy level of the conduction band of the electrochromic material and thus become free electrons. Ionization will also occur at the light-emitting center accordingly. Thus, when the free electrons are combined with the ionized light-emitting center, energy is released in the form of light. In some embodiments, the conductive layer 32 is an indium tin oxide (ITO) film, and the light emitted from the light-emitting layer 33 can be emitted outward from the conductive layer 32.

Referring to FIG. 2, in some embodiments, the transparent body 3 is light and thin (the thickness may be in the range between about 0.1 mm and 0.2 mm). The transparent body 3 has following characteristics: the light-emitting layer 33 evenly emits light outward; the emitted light is cold light so that the transparent body 3 is not heated; light weight and thin thickness; certain flexibility and ease of assembly;

resistance to shaking and impact; low power consumption, where the current density is generally in the range between 0.1 and 0.2 mA/cm$^2$; good waterproof property; the driving voltage applied to the transparent body 3 may be in the range between 40 and 200 volts (if the power source 6 is AC, the frequency of the AC may be in the range between 50 and 3000 Hz); the operating temperature is in the range between −35 Celsius degrees to 85 Celsius degrees; the service life can exceed 8000 hours; the power source 6 may be, but not limited to, a DC source, an AC source, or an automatic transfer switch (ATS) connected to a DC source and an AC source; with different types of activators inside the light-emitting layer 33, the light-emitting layer 33 can emit light of different colors. The color can be, such as, white, blue-green, blue, dark blue, yellow-green, green, red, or yellow. In some embodiments, the light-emitting layer 33 not only can emit the light of a single-color but also can emit lights of multi-colors by having different electrochromic materials in different areas.

In some embodiments, the marker line 2 is formed by at least one selected from the group consisting of a dot, a line, and a plane. That is, the transparent body 1 may be dot-shaped, linear-shaped or sheet-shaped in top-view. Each of the marker lines 2 may be at least one selected from the group consisting of a straight segment, an arc segment, and a circle segment. The marker lines 2 may be arranged to form texts, numbers, or any patterns.

Referring to FIG. 2, in some embodiments, each of the marker lines 2 further includes a floor color layer 36 as the bottommost layer of the marker line 2. The floor color layer 36 has a color substantially the same as the color of the floor of the indoor field. The floor color layer 36 is disposed below the electrode layer 35. When the conductive layer 32 and the electrode layer 35 are not energized, each of the marker lines 2 shows the floor color of the indoor field due to the existence of the bottommost floor color layer 36. Therefore, the marker line 2 as a whole can be regarded as a relatively invisible line as compared to the indoor field when the marker line 2 is not energized, thereby avoiding affecting the normal use of other court lines (field line sets 1). For example, when the indoor field is to be used as a basketball court, the marker lines 2 of other field line sets 1 not used for basketball (such as for badminton or for tennis) may show the floor color. In this configuration, the player using the indoor field will not mistake the field line sets 1 not for basketball (such as for badminton or for tennis) as the basketball court line, so that the problem of causing the player to be confused among multiple sets of court lines can be avoided. In addition, in this configuration, the referee will not make wrong judgement due to misreading the marker lines as well. It should be noted that, in some embodiments of the instant disclosure, for showing the court line as complete as possible, if two or more marker lines 2 are overlapped to form an overlapped region, only the bottom-most marker line 2 has the floor color layer 36 in that overlapped region.

Figure 3:
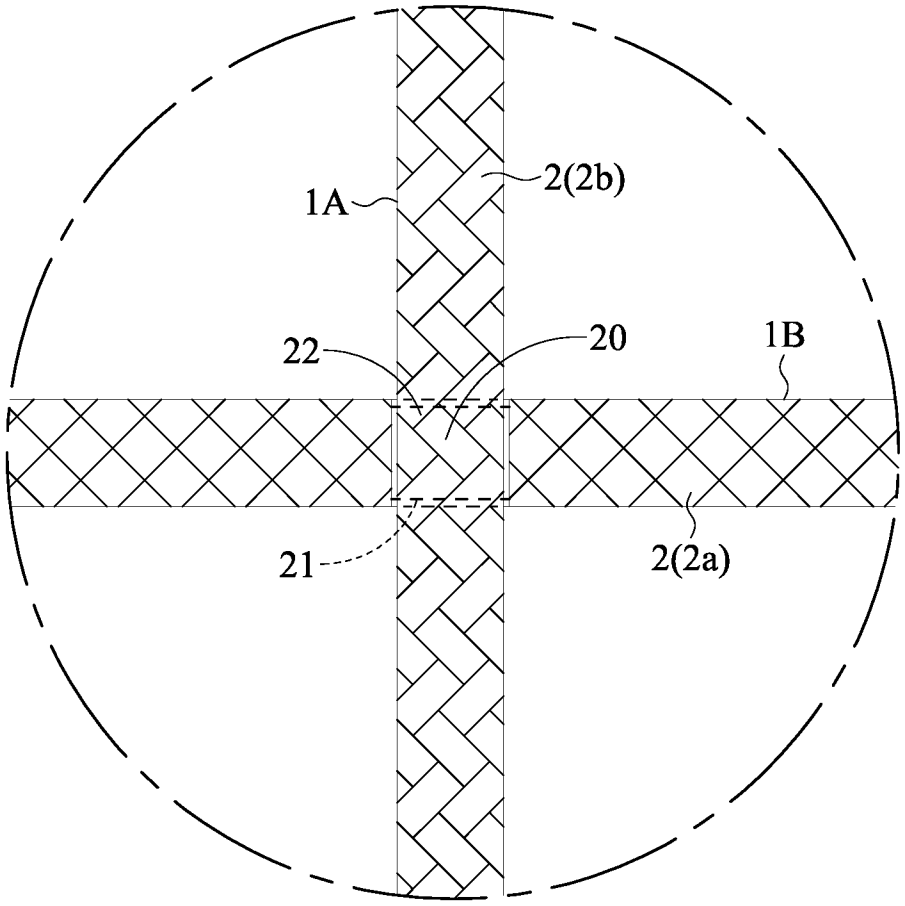
FIG. 3 illustrates a schematic enlarged view of the area indicated by the circle A shown in FIG. 1.

Please refer to FIG. 3. FIG. 3 illustrates a schematic enlarged view of the area indicated by the circle A shown in FIG. 1. In some embodiments, the display device 100 has a first marker line 2*a* and a second marker line 2*b*, wherein the first marker line 2*a* and a second marker line 2*b* may belong to the same field line set 1 or respectively belong to different field line sets 1. In some embodiments, the first marker line 2*a* and a second marker line 2*b* are intersected and overlapped with each other, and thus the first marker line 2*a* and the second marker line 2*b* are not parallel to each other. For example, the first marker line 2*a* and the second marker line 2*b* together form a cross shape (or can form a Y, K, or X shape). In some embodiments, the first marker line 2*a* and the second marker line 2*b* are intersected and together form four (or can be three or more than four if there are other marker line(s)) included angles all around the cross point with the same degree or different degrees. The included angle may be any angle in the range between degrees and 80 degrees.

Please refer to FIG. 3. In some embodiments, the first marker line 2*a* and the second marker line 2*b* are intersected and thus overlapped with each other, thereby forming an overlapped region 22. In this embodiment, the first marker line 2*a* has a hollow portion 20 located correspondingly at the overlapped region 22. At least one connecting segment 21 is on a side of the hollow portion 20, and the connecting segment 21 contacts the second marker line 2*b*. Since the hollow portion 20 is located at the overlapped region 22, excessive stacking of the marker lines 2 at the overlapped region 22 can be avoided. Therefore, the overall thickness of the field with the display device 100 will not increase too much as compared to the field without the display device 100, and thus the flatness of the ground is not affected.

Figure 4:
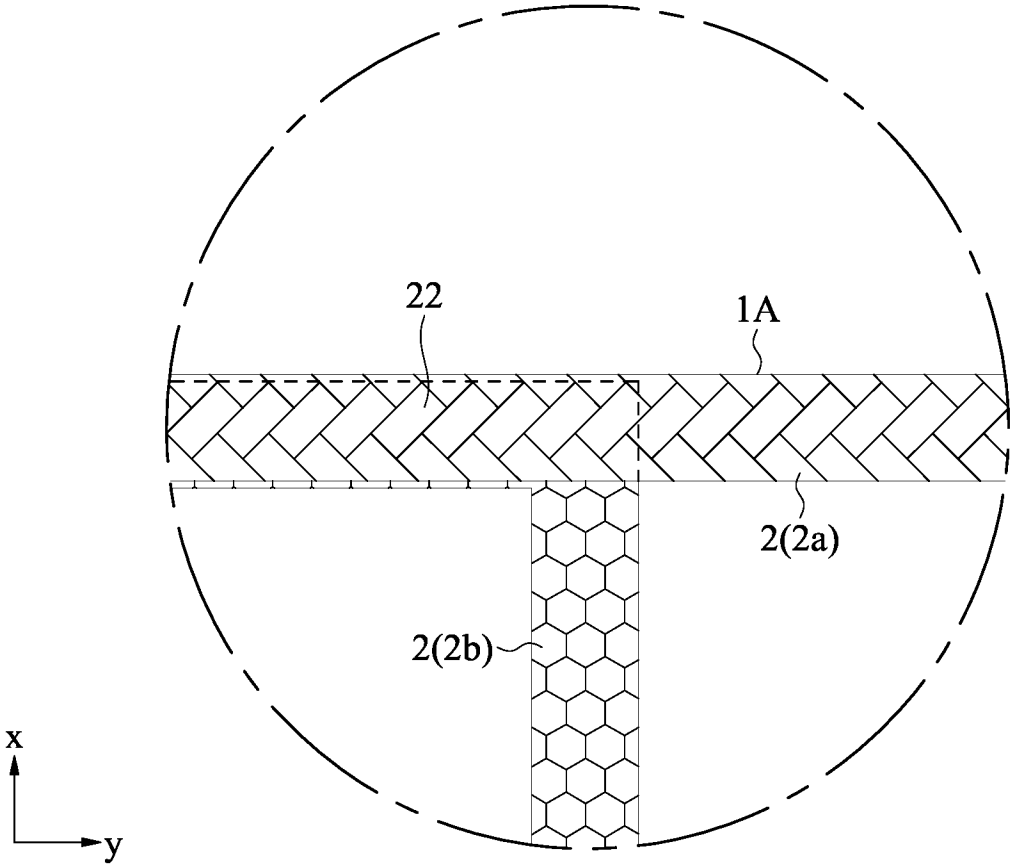
FIG. 4 illustrates a schematic enlarged view of the area indicated by the circle B shown in FIG. 1.

In some embodiments, in the overlapped area 22 formed by the first marker line 2*a* of one field line set 1 and the second marker line 2*b* of another field line set 1, the extension direction of the first marker line 2*a* and the extension direction of the second marker line 2*b* are parallel to each other. For example, as shown in FIG. 4, in the overlapped area 22, the extension direction of the first marker line 2*a* and the extension direction of the second marker line 2*b* are both parallel to the x-axis of the ground and thus are parallel to each other. In some other embodiments, in the overlapped area 22 formed by the first marker line 2*a* of one field line set 1 and the second marker line 2*b* of another field line set 1, the extension direction of the first marker line 2*a* and the extension direction of the second marker line 2*b* are not parallel to each other. For example, as shown in FIG. 3, in the overlapped area 22, the extension direction of the first marker line 2*a* (which is parallel to the x-axis of the ground) is perpendicular to the extension direction of the second marker line 2*b* (which is parallel to the y-axis of the ground).

In some embodiments, the head portion of the first marker line 2*a* overlaps the tail portion of the second marker line 2*b*. Alternatively, in some embodiments, the tail portion of the first marker line 2*a* overlaps the head portion of the second marker line 2*b*. Alternatively, in some embodiments, the central portion of the first marker line 2*a* overlaps the head portion of the second marker line 2*b*. Alternatively, in some embodiments, the head portion of the first marker line 2*a* overlaps the central portion of the second marker line 2*b*.

Please refer to FIG. 4. FIG. 4 illustrates a schematic enlarged view of the area indicated by circle B shown in FIG. 1. In some embodiments, the first marker line 2*a* of one field line set 1 and a portion of the second marker line 2*b* of another field line set 1 are parallel to and overlap with each other. For example, a portion of the L-shaped second marker line 2*b* is parallel to and overlaps the I-shaped first marker line 2*a*. For another example, as shown in FIG. 4, a portion of the L-shaped second marker line 2*b* rotated by 180 degrees is parallel to and overlaps the laid-down I shaped first marker line 2*a*.

Please refer to FIG. 1 and FIG. 2. In some embodiments, the display device 100 further includes a power source 6. The conductive line 39 of each of the marker lines 2 in each of the field line sets 1 is connected to the power source 6 and the transparent body 3. The power source 6 may be a DC source, such as a dry cell, a motorcycle battery, a car battery, etc. The power source 6 provides the light-emitting layer 33 of the display device 100 with electricity to emit light. In some embodiments, the power source 6 may be an AC source, such as a transformer connected to supply mains (e.g. 110 V/60 Hz). In this embodiment, the transparent body 3 is connected to supply mains through the conductive line 39, and the supply mains is further transformed by the transformer before being used. In some embodiments, the power source 6 may be an automatic transfer switch (ATS) connected to a DC source and an AC source, thereby being capable of providing a transferring essential load connection between primary (e.g. AC source) and the alternate source (e.g. DC source) of electrical power when the primary power source becomes unavailable.

Please refer to FIG. 1. In some embodiments, each of the marker lines 2 includes a contact detector 8 (as shown in FIG. 2), and the contact detector 8 is located in the transparent body 3. In some embodiments, the contact detector 8 may be a pressure detector disposed in the transparent body 3 (hereinafter, a "sheet" is used as an example of the contact detector 8, and the sheet is given the same reference numeral as the contact detector 8). The sheet 8 (or can be referred to as piezoelectric sheet) may be a stainless steel sheet, a silicon sheet, etc. The sheet 8 is used to measure the pressure applied to the transparent body 3 by the weight of a ball or by other forces (such as a foot stepping force applied on the sheet 8), and the measured outcomes will be converted into an electrical signal for being output. In some embodiments, the sheet 8 can be a strip-shaped or block-shaped piezoelectric polymer. The sheet 8 is arranged vertically and/or horizontally on a circuit board, and the circuit board is disposed in the transparent body 3 to form an electrochemical sensor. The electrochemical sensor can determine one or more landing point(s) of the ball, which can be used for identifying parameters of the falling ball, such as the speed of the ball.

To sum up, in some embodiments, the light-emitting layer of the display device is made of a material including an electrochromic material. Therefore, by energizing the light-emitting layer of the desired marker lines to display desired court lines only, the problem of causing users to be confused among multiple sets of court lines can be avoided. In some embodiments, the display device is adapted to display more than two kinds of court lines in the same indoor field, and thus the land cost can be further reduced. In some embodiments, the transparent body of the display device can be directly disposed on the existing indoor field, so that the existing indoor field does not need additional operations such as digging holes and burying lines, thereby simplifying the installation of the display device.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A display device for showing a court line, wherein the court line is adapted to be shown on an indoor field, and the display device comprise:

a plurality of field line sets disposed on a predetermined field, wherein the field line sets together have a plurality of marker lines, and at least two of the marker lines overlap with each other to form an overlapped region;

each of the marker lines comprises:

a transparent body, wherein the transparent body includes a protective film, a conductive layer, a light-emitting layer, an insulating layer, and an electrode layer; the protective film, the conductive layer, the light-emitting layer, the insulating layer, and the electrode layer are arranged in sequence from top to bottom; the light-emitting layer is made of a material comprising an electrochromic material;

each of the marker lines in each of the field line sets has an independent circuit loop formed by a conductive line.

2. The display device according to claim 1, wherein each of the marker lines is formed by at least one selected from the group consisting of a dot, a line, and a plane, and each of the marker lines is at least one selected from the group consisting of a straight segment, an arc segment, and a circle segment.

3. The display device according to claim 1, wherein each of the marker lines further comprises a floor color layer as the bottommost layer of the marker line, and the floor color layer has a color substantially the same as a color of the predetermined field.

4. The display device according to claim 1, wherein the marker lines have a first marker line and a second marker line, and the first marker line and the second marker line belong to the same field line set or respectively belong to different field line sets;

wherein the first marker line has a hollow portion located correspondingly at the overlapped region.

5. The display device according to claim 4, wherein the first marker line has a connecting segment, and the connecting segment is on a side of the hollow portion and contacts the second marker line.

6. The display device according to claim 4, wherein in the overlapped region, an extension direction of the first marker line and an extension direction of the second marker line are not parallel to each other.

7. The display device according to claim 4, wherein in the overlapped region, an extension direction of the first marker line and an extension direction of the second marker line are parallel to each other.

8. The display device according to claim 1, wherein each of the marker lines has a contact detector located in the transparent body.

9. The display device according to claim 1, wherein the court line is configured to be shown on the indoor field.

10. An indoor field having the display device as claimed in claim 1.

* * * * *